United States Patent [19]

Trias

[11] Patent Number: 4,949,442

[45] Date of Patent: Aug. 21, 1990

[54] DEVICE FOR REMOVING YARN RESIDUE FROM TEXTILE TUBES

[76] Inventor: Jose R. Trias, Fontcuberta 34 -Urbanización, "La Coromina", Manlleu (Barcelona), Spain

[21] Appl. No.: 330,107

[22] Filed: Mar. 28, 1989

Related U.S. Application Data

[60] Division of Ser. No. 195,242, May 11, 1988, which is a continuation-in-part of Ser. No. 756,964, Jul. 18, 1985, Pat. No. 4,783,887.

[30] Foreign Application Priority Data

Jan. 22, 1985 [ES] Spain ..... 529741

[51] Int. Cl.[5] ..... B65H 73/00

[52] U.S. Cl. ..... 28/297

[58] Field of Search ..... 28/297

[56] References Cited

U.S. PATENT DOCUMENTS 1,740,127 12/1929 Terrell ..... 28/297

4,097,976 7/1978 Ferguson et al. ..... 28/297

*Primary Examiner*—Werner H. Schroeder

*Assistant Examiner*—David K. Suto

*Attorney, Agent, or Firm*—Michael J. Striker

[57] ABSTRACT

The device for removing yarn residue for textile tubes including jaws; a mechansim for opening the jaws including a plurality of rollers and biased wedges supporting the rollers and the jaws, stringers arranged to engage and push apart the rollers and therefore push apart the wedges and the jaws, and a pawl device for guiding the stringers into engagement with the rollers for moving apart the jaws; a mechanism for closing the jaws which biases the jaws to close towards each other; a guide member formed so as to center the textile tubes relative to the jaws and having two tapered tips formed to hold the textile tube longitudinally therebetween; and a mechanism for moving the guide member in opposite directions between the jaws reciprocally. One of the tips is arranged to receive the yarn residue retained by the jaws and the other tip is formed on the guide member. The first tip includes a displaceable spring-loaded sleeve so that the yarn residue actually collects on the sleeve and a mechanism for displacing the sleeve so as to expel the yarn residue collected thereon.

6 Claims, 17 Drawing Sheets

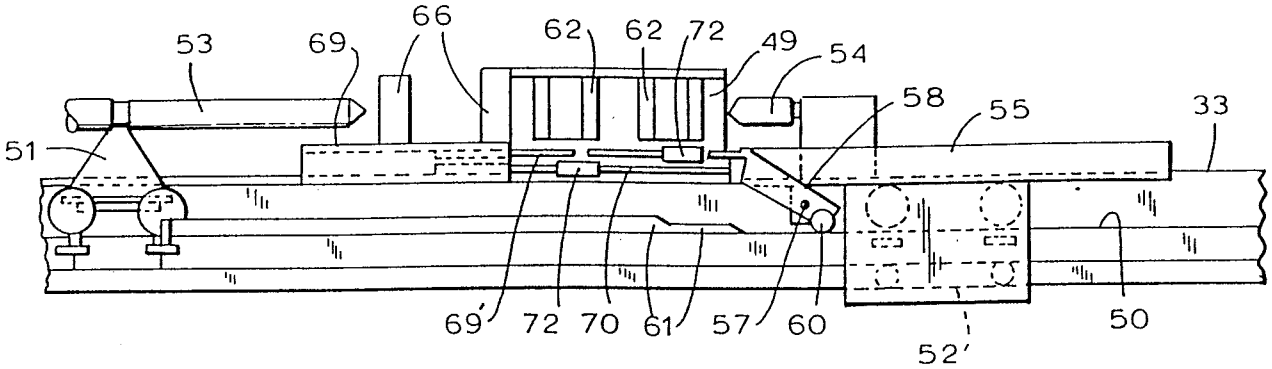
FIG. 9
FIG. 12
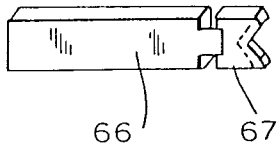

DEVICE FOR REMOVING YARN RESIDUE FROM TEXTILE TUBES

This is a division, of application Ser. No. 195,242, filed May 1, 1988 which in turn is a continuation-in-part application Ser. No. 756,964 filed July 18, 1985, now U.S. Pat. No. 4,783,887 issued Nov. 15, 1988.

BACKGROUND OF THE INVENTION

The present invention relates to a machine designed for classifying, cleaning and arranging textile tubes and, more particularly, to a device for removing yarn residue from textile tubes.

Various machines for the classification and arrangement of textile tubes are known for example from Italian patents, Nos. 748,403, 988,521, and 922,333. In these machines, inclined elemental planes are used to obtain the classification necessary. However, this leads to intermingling of clean tubes and tubes holding residues of yarn.

Spanish patent No. 504,516 by the same inventor illustrates a typical unpiling device. When tubes are fed horizontally into an intake section, the tubes themselves may be stacked on top of each other and require separation from each other. An unpiling device is able to unstack the tubes by separating them as the tubes pass between two pairs of rollers.

FIGS. 29, 30 and 31, 32 demonstrate separation or unstacking of the tubes from each other where the narrower end of the tubes is fed first (FIGS. 29, 30) or the wider end of the tubes is fed first (FIGS. 31, 32) into the unpiling device.

The tubes T are fed first between first rollers 290, 270 and urged forward between second rollers 300, 280. Second rollers 300, 280 rotate faster than first rollers 290, 270 so that the first fed tube is urged forward by the rollers 300, 280 at a faster rate than is the tube underneath, which is still being urged forward by rollers 290, 270. Top rollers 290, 300 are free to rotate but are elastically compressed toward bottom rollers 270, 280 respectively to thereby ensure that the tubes are urged forward between each pair of rollers.

SUMMARY OF THE INVENTION

It is an object of the present invention to overcome the deficiencies of the prior art and to eliminate labor to the greatest extent possible by having all operations performed automatically.

Pursuant to this object, and with others which will become apparent hereinafter, one aspect of the present invention resides in a machine which is electromechanical, pneumatic and hydraulic, and is fed by tubs or containers which are emptied into a storage bin by means of a dumping device. Tubes are then classified by means of conveyor belts, tubes with yarn residues being separated from clean tubes. The clean tubes are transported directly to the head of the arranging section of the machine and are counted and packed in removal tubs in the same direction or alternating, as necessary. The tubes with yarn residues are lifted and deposited in vibratory bins which feed a cleaning head. The vibratory bins automatically perform the operations of alignment, orientation of the tube and verification that the tube has entered the head correctly.

Because of its versatility, the machine is capable of cleaning tubes of various sizes without having to be adjusted. Alternatively, their cleaning action may be supplied independently of the arranging section.

The conveyor belts of the present invention have articulated elements which allow only the clean tubes, but not those holding residues of yarn, to fall, by gravity. This represents a great advantage over the embodiments of the Italian patents mentioned, in which recourse is necessitated to a system of inclined elemental planes to obtain in a very imperfect way the classification.

The device of the present invention is advantageous in comparison to that of the prior art, since now perfect selection of the tubes is obtained, so that if upon intake into the machine a tube is lacking yarn residues, it passes immediately to conditioning for subsequent use and, if the tube appears with yarn residues, such residues are eliminated in a simple and effective way.

It is a further object to provide a mechanism for capturing, turning and aligning the textiles tubes for subsequent removal of yarn residue. Such a mechanism feeds the tubes through a constricted mouth at the end of a slope to a clamp, which orients the textile tubes as required to direct a wider end of the textile tubes forward.

It is another object to provide a removing device which receives the wider end of the textile tubes first and removes the yarn residue and yet minimizes the pressure being applied on the textile tube itself.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIGS. 9, 10 and 11 show in front elevation, in plan and in partially cross sectional elevation views, respectively, the mechanism for cleaning tubes;

FIG. 12 is a perspective view showing the details of one of the elements forming part of the mechanism of FIGS. 9 through 11;

DESCRIPTION OF THE PREFERRED EMBODIMENTS

Figure 2:
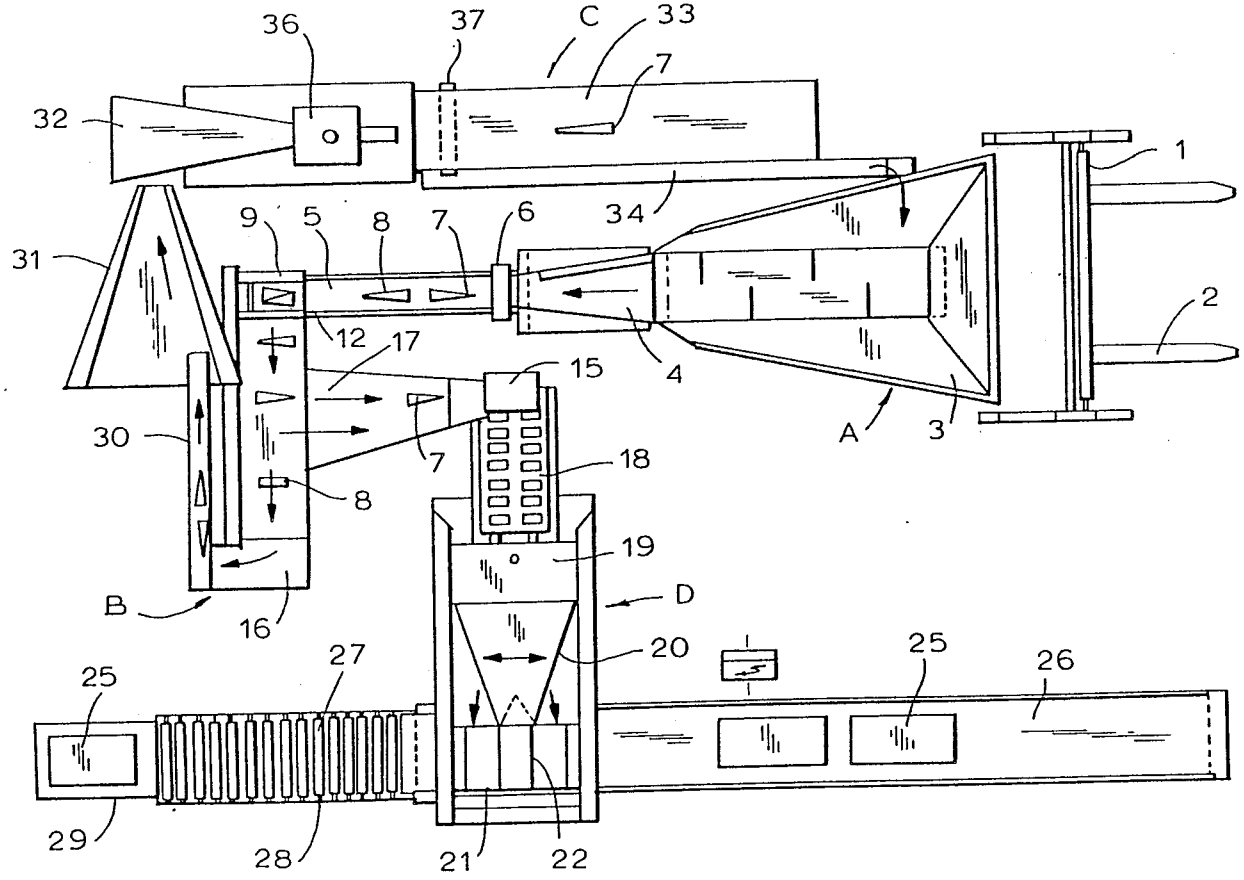
FIG. 2 is a plan view of the machine in FIG. 1.

The machine of the present invention is divided into four principle sections: an intake section (A), a classifying section (B), a cleaning section (C), and a final arranging section (D) (see FIG. 2).

Intake section A receives tubes mixed in large quantities from the coil winding machines. Some tubes have large yarn residues, others have small yarn residues. Intake section A lines up the tubes on an endless belt 4, 5 in order to feed them to the classifying section B, which operates neither by photo-cell nor by feeler gage. Then, all the tubes with either large or small yarn residues are automatically sent to the cleaning section C, without any selection process taking place, that is, no selection process is used to distinguish those tubes having small yarn residues from those having large yarn residues.

The cleaning section C is automatically fed, operating with an extraction system using nippers (FIG. 10) and self-cleans, so that the extraction is effected evenly over the whole yarn. No brush is used to unravel. Cleaned tubes are fed into an arranging section D that orientates them as appropriate, counts them and packs them into tubs for further use in spinning stations. These tubs can be handled manually or automatically.

Figure 1:
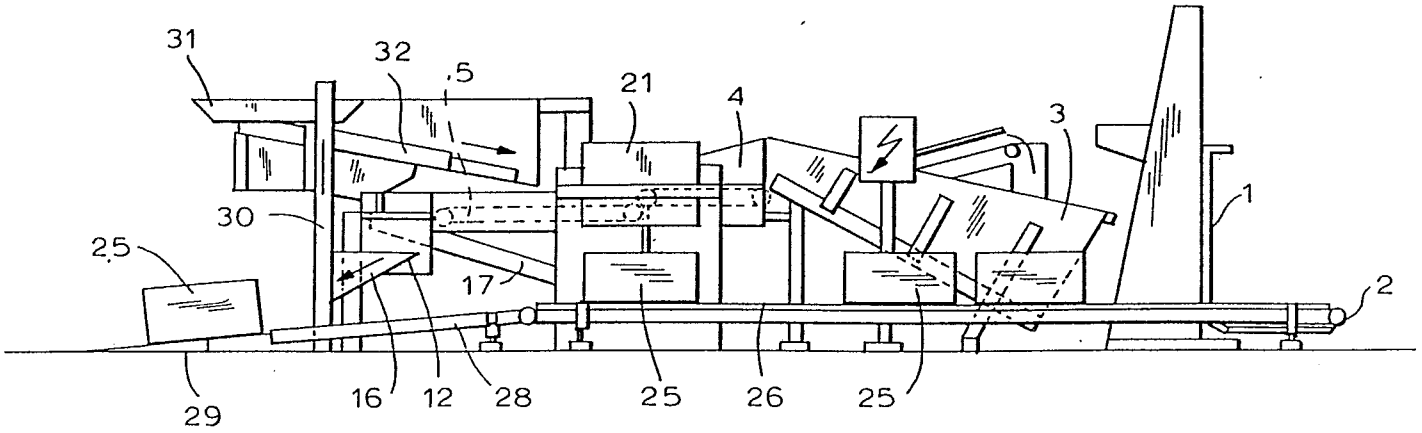
FIG. 1 is a front elevation view of a machine incorporating the present invention.

As can be seen from FIG. 1, section A comprises an elevator 1 and a container conveyor 2, designed to dump the textile tubes (with or without yarn residues) coming from the spinning machines into a bin 3. The bin 3 is followed by endless belts 4 and 5 and an unpiling device 6 appearing at the intake of the belt 5. The unpiling device 6 is protected by another patent of the same applicant, Spanish Patent No. 504,519, but which in the present case, has detachable rollers. Both clean textile tubes 7 and those carrying yarn residues 8 end up on this belt 5. Mixed together, these tubes enter a box 9 from which they will pass to the classifying section B which includes in this embodiment the elements represented in FIGS. 4 through 6.

Figure 4:
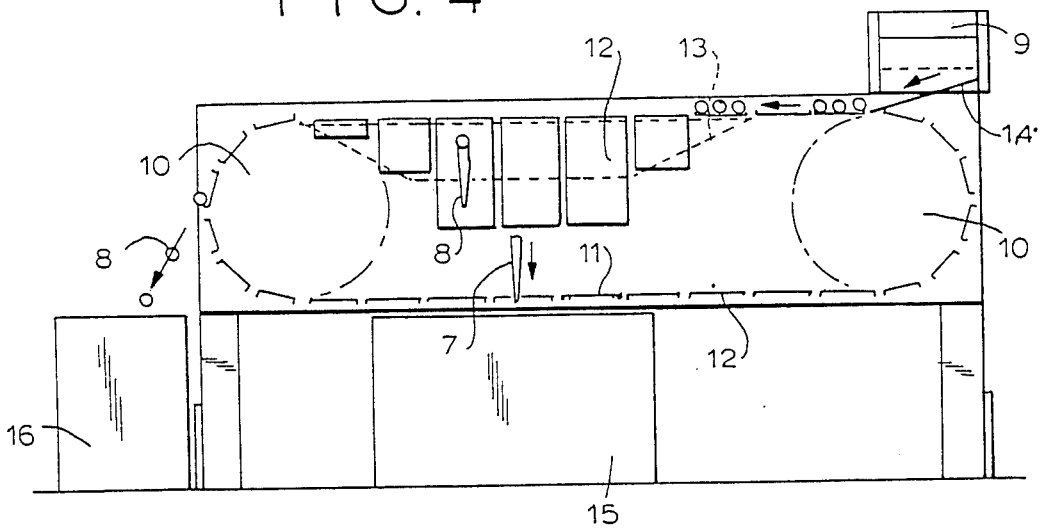
FIGS. 4, 5 and 6*a* illustrate in front, side elevation and in plan, views respectively, the mechanism of the classifying section of the machine.
Figure 6A:
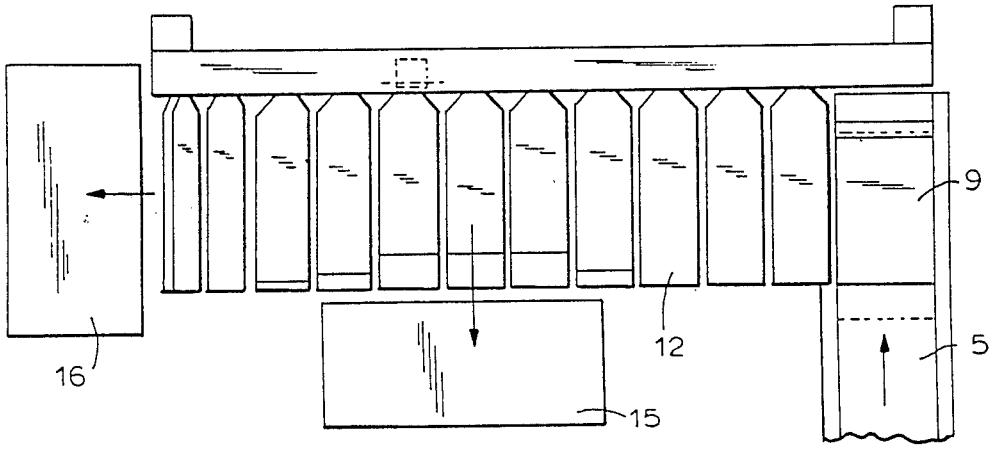
Figure 5:
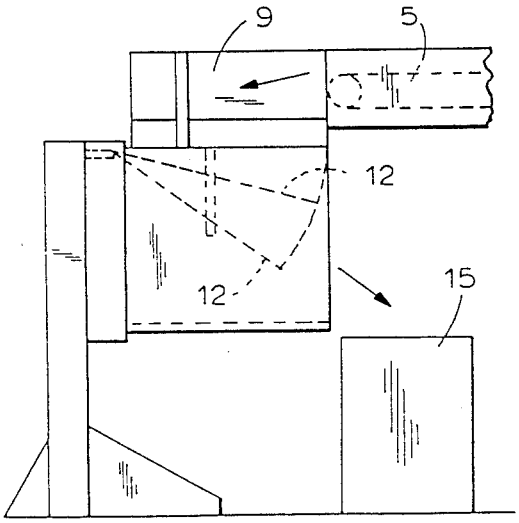
Figure 6B:
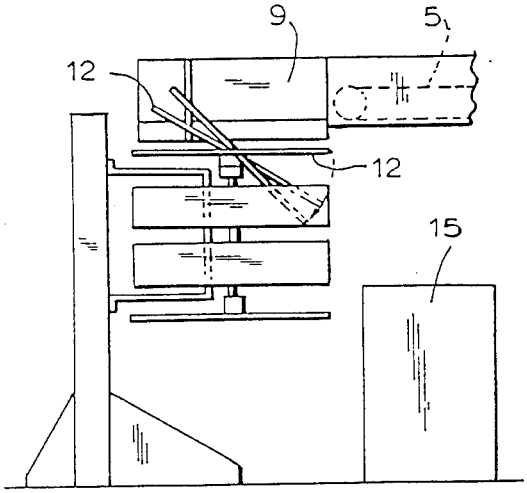
FIG. 6*b* is a plan view of another embodiment of the mechanism of FIGS. 4 through 6*a;*

This section B comprises a mechanism made of a frame on which two drums 10 are mounted to conduct a chain or endless belt 11. Articulated at one of the ends (FIGS. 4–6*a*) or else at the center (FIG. 6*b*) of the chain are multiple plates or pans 12, essentially rectangular in shape and having a wrinkled or rough upper surface. The chain 11 and pans 12 travel on a guide 13 which at the top has a section which is depressed or at a lower level and is duly shaped so that the pans 12, at their free end, i.e., at the end not articulated to the chain 11, may descend by gravity to form momentary slopes which follow one another in a continuous fashion. During the rest of the run, the pans 12 are displaced horizontally as seen in FIGS. 4–6. The tubes 7, 8 fall from the box through the plane 14 and to the belt of pans 12. When the pans reach their zone of inclination, the clean tubes 7 are unable to avoid the slope and descend into a collection box 15, while the tubes 8 bearing yarn residues stick to the rough pans 12 and are transported to the discharge of the classifying section B and deposited in another box 16. This results in an accurate separation of the originally clean tubes 7 from those bearing yarn residues. As can be seen, this mechanism takes advantage of gravity and the effect of adhesion, which has no effect when the tubes are clean, whereupon they must necessarily slide. The effect of the adhesive surface of the plates or pans 12 (which has edges to contain the tubes, as seen in FIG. 4) may be due either to roughness, knurles, spines or the like, which will act to hold tubes 8 bearing yarn residues.

Figure 24:
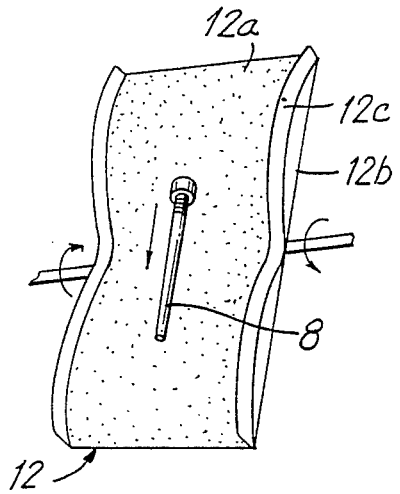
FIG. 24 is an enlarged perspective view of a tiltable pan with a tube thereon.
Figure 25:
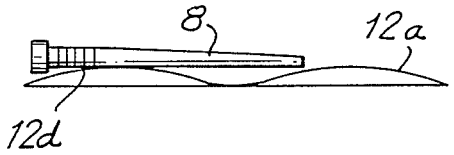
FIG. 25 is a side view of the pan with tube thereon of FIG. 24.
Figure 26:
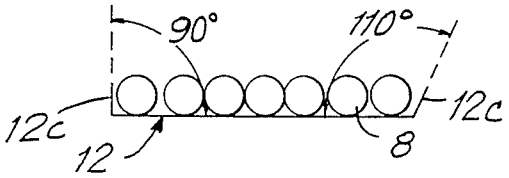
FIG. 26 is a back view of the pan of FIG. 24 but only depicting the upper surface and wall of the pan, together with a plurality of tubes lying thereacross.
Figure 27:
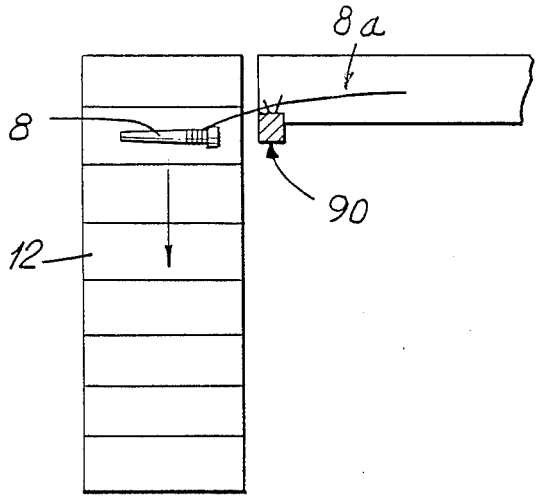
FIG. 27 is an embodiment for cutting caught yarn as the tube progresses on the pans.

As shown in greater detail in FIGS. 24–27, the pans 12 have a wavy-like surface 12*a* of variable slope, i.e. undulated (see FIGS. 24–25). The undulated surface is rough or harsh to allow the head of the tube to be placed in any orientation having a diameter of clearance.

The base 12*b* of such pans 12 is plain, on which the undulated surface 12*a* is mounted. Several tubes may be placed on the pans 12 at the same time. The bordering walls 12*c* of the pans 12 have a difference in their slope to prevent tubes from becoming locked (see FIG. 26). When these pans 12 receive tubes, they are always in a horizontal position (FIG. 25), which allows yarn residues on the tube to fasten onto the rough surface of the pan 12 to establish a good contact at 12*d* of FIG. 25. When such pans 12 are then inclined downward vertically, clean tubes slide down perfectly (FIG. 6*b*). Scissors 90 may be installed to automatically cut caught yarns 8*a* (see FIG. 27).

Thus, the number of tubes that may be delivered is not limited to one by one. As many as 10,000 tubes per hour can be classified using a single classifying unit. Delivery and receipt of the tubes in the classifying section B does not require synchronization. Only the delivery slope is adjusted, not that of the receiving element; tubes are received on the rough surface of the pans.

The protection of the tube surface (normally cardboard) is maximized by the present invention by the tiltable pans 12 which adjust in dependence upon weight and adherence of the tubes. Tiltable pans 12 can bear different coatings, such as pins, cloth, etc. and are easy to replace. The pans 12 are arranged to be interlinkable with an arranging station, tubs and belts, cleaning section, etc. The pans 12 are self-cleaning.

Figure 28:
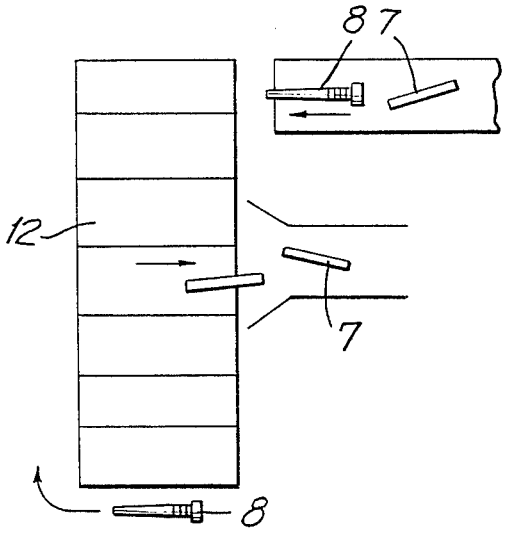
FIG. 28 is a top view of the classifying section in which the tubes are being sorted.
Figure 29:
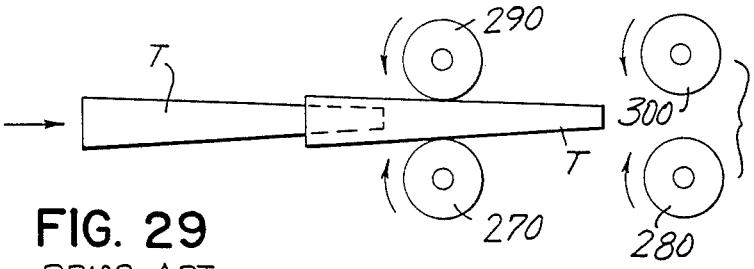
FIG. 29 PRIOR ART
FIGS. 29 and 30 are side views of an unpiling device of the prior art depicting tubes becoming uncoupled by passing through with their narrower ends first.
Figure 30:
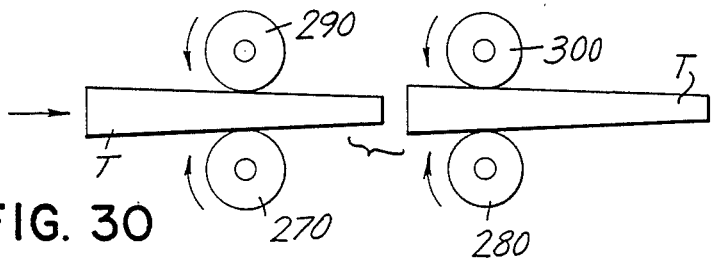
FIG. 30 PRIOR ART
Figure 31:
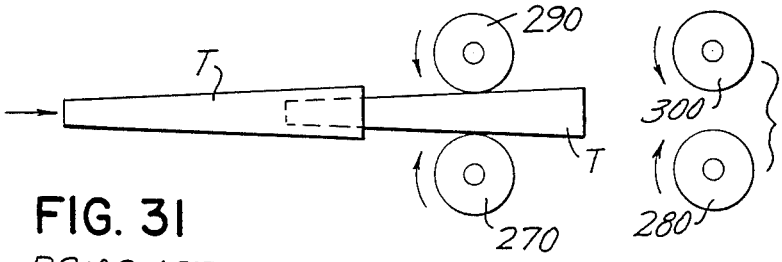
FIG. 31 PRIOR ART
FIGS. 31 and 32 are similar to FIGS. 29 and 30 except that the tubes are oriented to pass through with their wider ends first.
Figure 32:
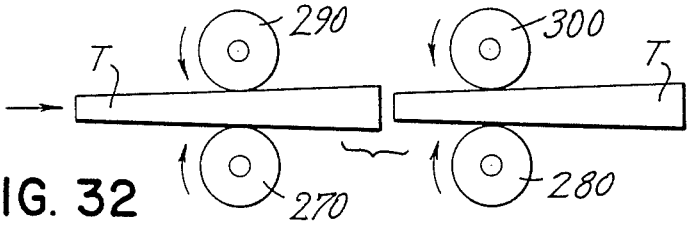
FIG. 32 PRIOR ART

Also, when the tube is deposited on pan 12, which has a gradual slope, the surface of the tubes remains protected and yet adherence between the tubes and the rough coating is also secured. The tubes enter parallel to the pans 12 of the classifying section, which means an angle of 90 degrees is formed relative to the direction of travel of the pans 12. Clean tubes 7 go out in the same sense (see FIG. 28). This prevents the yarn from becoming unwound, which could then surround the classifying section and saturate it. The tubes do not slide in a direction opposite to that of rotation and the travelling direction of the pans, so that adherence between the pans and the tubes do not damage the latter.

Figure 3:
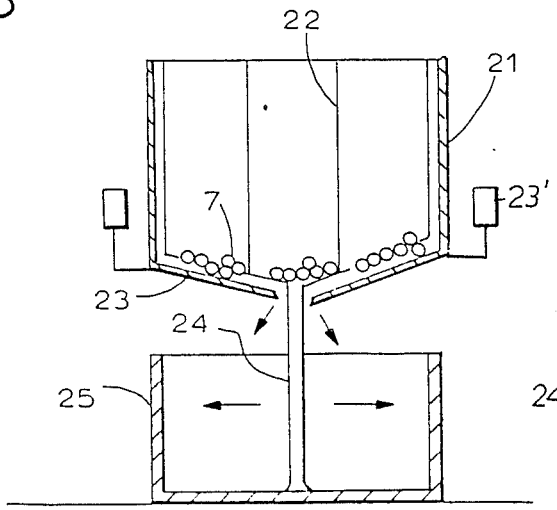
FIG. 3 is a detailed cross sectional view of the machine showing final filling of the tubs with their gates closed and holding tubes which are already clean.

To reach the box 15, the clean tubes 7 pass through an inclined zone 17 (FIGS. 1 and 2) and are collected and raised from the box 15 by an endless belt 18 belonging to the arranging section D. The belt 18 is provided with suitable protuberances for capturing the tubes 7 and delivering them to another belt 19 in communication with channeling walls 20 which orient the tubes so that they advance with their end or base of greater diameter always directed forward, unless before reaching the walls 20 means are provided to cause the tubes 7 to move in any position toward the point of discharge which is a receptacle 21. The receptacle 21 is divided into compartments by partition 22 (FIGS. 2 and 3), and has a base made up of hinged gates 23, which are opened and closed by pneumatic cylinder 23'. Two elastic sheets 24 are provided (concerning the central compartment) so as to hang vertically like curtains into tubs 25 which will be filled with the clean tubes 7. The task of the sheets 24 is to prevent tubes 7 of the central compartment from leaving, by their free fall, the orientation that they have received. This provision is not made for the side compartments because the walls of the tub 25 themselves act as a guide. The tubs 25 are transported by an endless belt 26 which delivers them to a train of rollers 27, mounted on a frame 28 from which they are collected at the end 29.

When gates 23 are closed, the compartments can be filled with tubes 7 oriented lengthwise (note channeling walls 20 between which passes the tubes 7). The elastic sheets 24 are laying against each other. When gates 23 are opened, elastic sheets 24 traverse the tub 25 in accordance with the directional arrows shown in FIG. 3, because gates 23 no longer apply any pressure to them. The tubes 7 will fall inside the tub 25 and the elastic sheets become suspended vertically as an extension of partitions 22.

Elastic sheets 24 remain parallel inside the mentioned tub 25 and allow the tubes stored inside the upper partitions to fall down freely but in an orderly way, remaining thus correctly located and lined up inside mentioned tub 25.

Concerning the tubes 8 with yarn residues, which fall into the box 16, they are lifted from the box 16 by an endless belt 30 which delivers them to a vibratory bin or hopper 31, which is followed by another vibratory bin or hopper 32 having the same action and has a bed 33 which is in lateral communication with an elevating conveyor belt 34 whose high discharge pan empties into the intake bin 3 of section A (FIG. 2), and in addition allows the yarn residue to fall outside the bin 3. The vibratory bins or hoppers 31, 32 line up the tubes for subsequent delivery to a first handling mechanism 36.

In the bed 33 of the cleaning section C are provided a first handling mechanism 36 and a second cleaning mechanism 37, whose makeup is represented in detail in FIGS. 7–8 and 9–12, respectively. The task of the first mechanism 36 is that of capturing the tubes 8 with residues (regardless of their orientation) and by means of an angular movement, which turns and aligns the tubes 8, transfers them one by one to the lower level to the second cleaning mechanism 37. The above-mentioned angular movement, in which the tube 8 describes a perfect arc, is limited to such displacement if the captured tube 8 has been caught with its larger end or base directed forward, but if not, due to an electrical system to be explained below, the mechanism 36 automatically changes position, defining an angle of 180° to locate the larger end of the tube forward in order to deliver the larger end first to the second cleaning mechanism 37. The tubes which now emerge from the second mechanism 37 without yarn move onto the bin 3, but since they lack yarn, they will follow the normal path until they reach the end of the process, accommodating themselves, as previously indicated, in the tubs 25.

In the event two tubes are trapped by the handler device 36 (FIGS. 7 and 8), both would be expelled. Also, if the diameter of two tubes permits their piling into the vibratory bins 31, 32 (FIG. 2) of the automatic feeding station, then the device depicted in FIGS. 7 and 8 would prevent the tubes from entering the cleaning station and avoid breaking or damaging the equipment.

Figure 8:
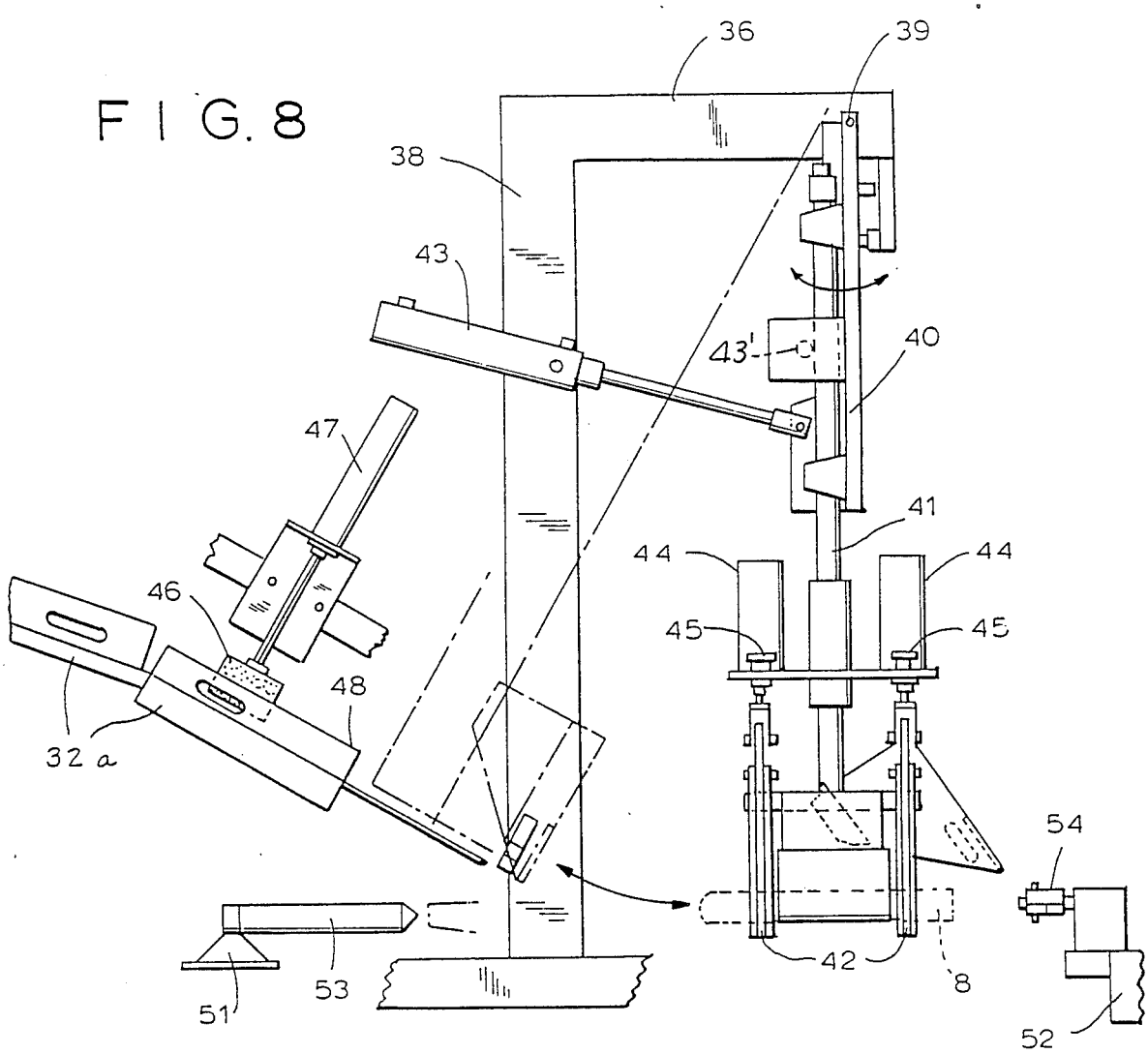
FIGS. 7 and 8 are side and front elevation views, respectively of the mechanism for driving, turning and aligning the textile tubes to be cleaned.
Figure 7:
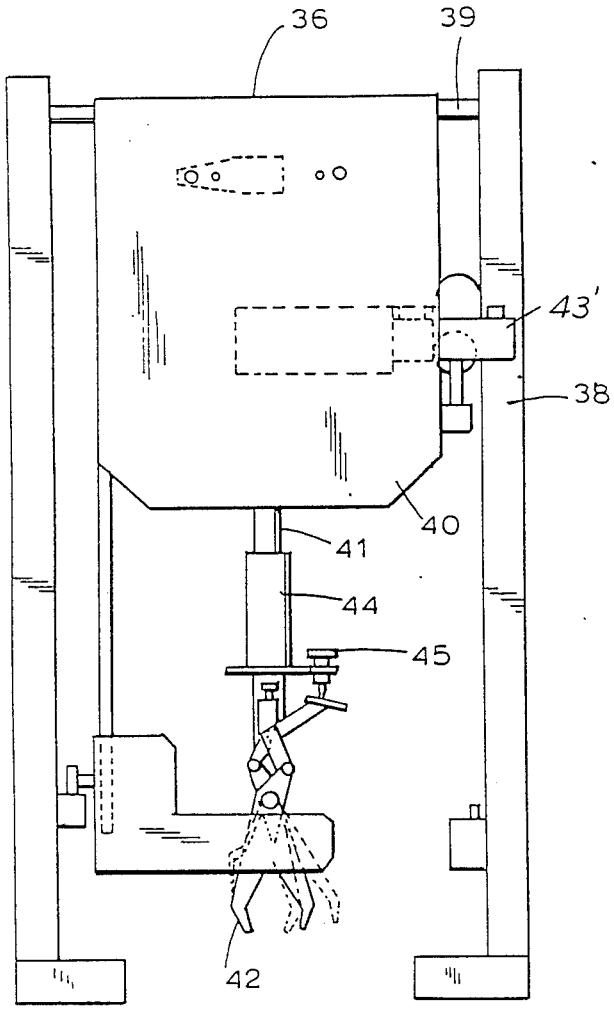
Figure 11:
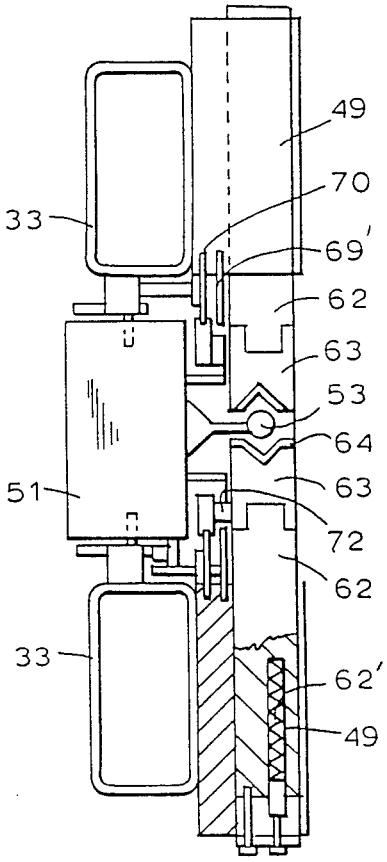

The first handling mechanism 36, as seen in FIGS. 7 and 8, comprises an inverted "L" support 38 and a rocking frame 40, the upper part of which is hinged at point 39 to inverted "L" support 38 which is driven by pneumatic cylinder 43 and has a rotary vertical shaft 41. The bottom of the rotary shaft 41 is coupled to a pair of clamps 42 which are designed to trap or capture the tube 8 and, if the tube is oriented with its small base forward to turn it 180° about the shaft 41 by means of a pneumatic cylinder 43'. Each of the clamps 42 is opened and closed by a pneumatic cylinder 44. The pneumatic cylinder 43' whose ends of its stroke are switched by microswitches 45, acting as a function of the outside diameter of the respective clamp, are used for the above-mentioned reversal direction to effect the 180° turn.

Clamps 42 have available an upper extension enlarging the movement. Through this extension one acts on microswitches 45, which, duly switched on to cylinder 43', gives the correct position to the tube trapped by clamps 42.

At the lower end of the slope 32*a*, by which the tubes 8 with yarn residues descend, an element is arranged for braking the tubes, including a spongy member 46 movable axially with the aid of another pneumatic cylinder 47. The spongy member 46 holds back the tubes 8, without injuring them, in rhythmic fashion so that upon passing through a constricted mouth 48 they emerge one by one and can be caught by the clamps 42.

The second cleaning mechanism 37 follows the first handling mechanism 36, and as can be seen in FIGS. 9–12 consists of two boxes 49 fixed to two stringers comprising the bed 33, each of which on the inside has a rail or longitudinal guide 50 by which two cars 51, 52, which are provided with a special rolling system, may be displaced. Of these cars, a first one 51 is the bearer of a centering and retention tip 53 of the tube 8, while the second car 52 has a second tip 54 and two stringers 55 with beveled ends 56. The second car 52 also has a transverse front shaft 57, with two lateral pawls 58 tensioned by a spring 59 and each having a roller 60 supported on a guide 50 which in a given sector, has a double step 61 for the pawls 58 to assume two levels in their advance.

Yarn is removed from tubes by passing the tubes with yarn residue between jaws 63 in such a way as to minimize pressure on the tube 8 itself. Tips 53 and 54, associated with cars 51 and 52, respectively, support tube 8 as tube 8 passes backward between jaws 63. Stringers 55 fastened to car 52 will cause jaws 63 to open until tip 54 advances far enough.

In the boxes 49 are housed two pairs of slides 62 elastically compressed by means of spring 62', and to which jaws 63 are articulated. The jaws 63 are equipped with mouths at an angle and provided with semi-hard linings so as not to injure the tube 8. These jaws 63 are tightly held in a position of mutual closure by the effect of a plurality of springs 65. Contiguous to each displaceable slide 62 are two slats 66 fixed to the stringers of the bed 33 and equipped with further articulated jaws 67, with a likewise angular mouth (FIG. 12), which are in planar position and pressed by springs 68. This system for articulation for the slides 62 and slats 66 is such that all of the jaws open in one direction (see arrows on drawings), i.e., they automatically close in the direction of advance of the tip 53.

Below the boxes 49 and an addition 69, two flat cut-out wedges 69' and 70 are mounted sliding with one superposed on the other. The wedges 69', 70 have an inclined edge 71 which contacts with rollers 72 integral with the slide 62. The wedges 69', 70 in addition have an edge 73 and a tail by which they are each joined to a return spring 74.

Figure 10:
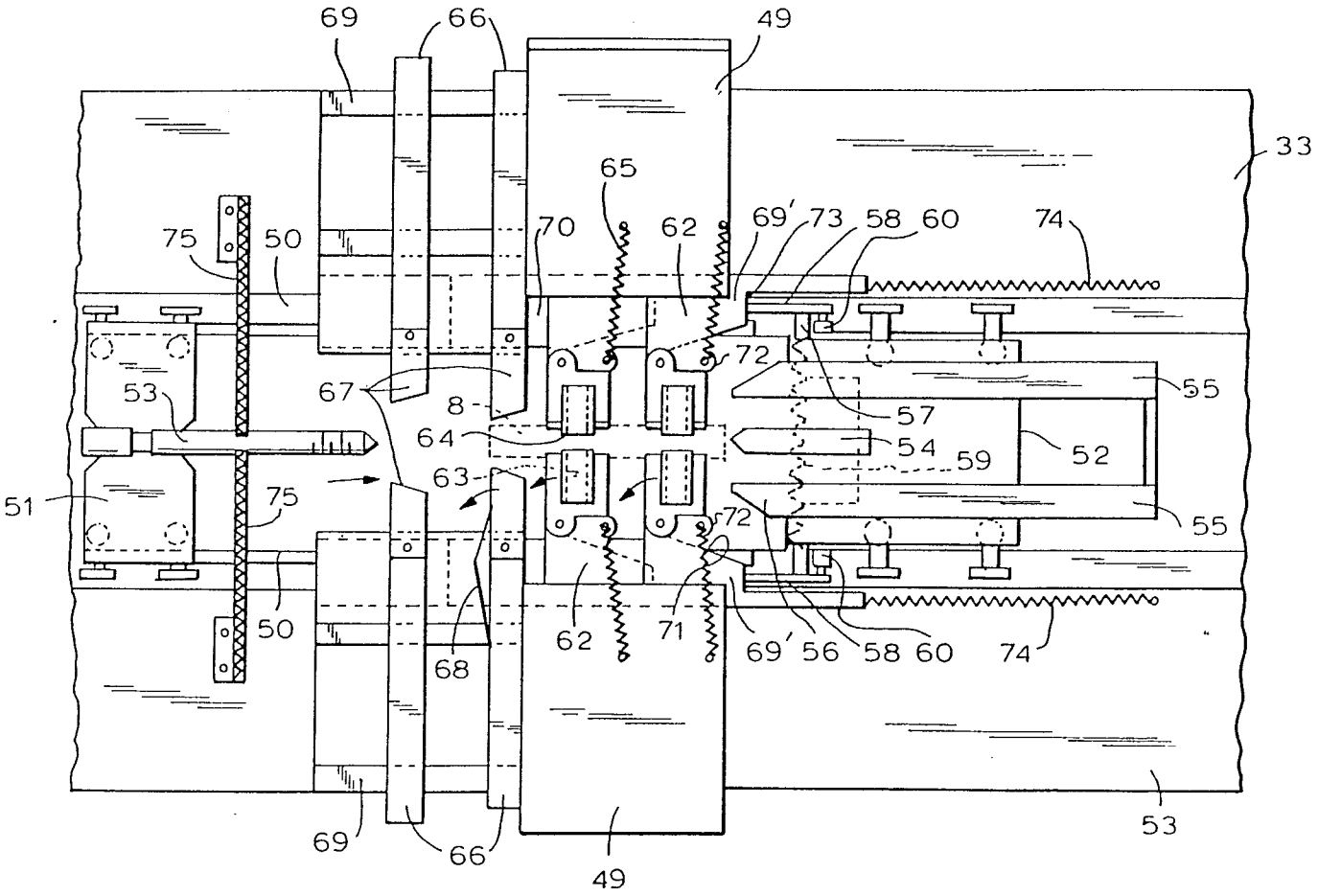

The mechanism described is completed by elastic strips 75 fixed to the stringers of the bed 33. The end of the elastic strips 75 define a mouth like that of the aforementioned jaws, applied in this case, about the tip 53 (FIG. 10).

The extraction of a tube 8, which happens to be caught by the jaws 63 due to defect or fracture of the tube, is effected gently owing to the recovery of the jaws, all of this being done in response to the impulse of the guide tip 54.

Concerning extraction of the yarn, this takes place in such a way that the tube 8 is not captured between jaws 63 but rather that the pressure on the tube is minimal. In the phase of extraction, the wedges 69, 70, together with the rollers 72, makes the backward motion of the jaws 63 impossible.

The wedges 69', 70 control the jaws 63 so as to not allow them to runback at the moment the yarn is being withdrawn. The carry pawls 58 withdraw the wedges 69' 70 to allow the jaws 63 to freely runback. The jaws 63 are withdrawn by the stringers 55 assembled on the car supporting the tip 54. The double steps 61 control the carry pawls and are in a fixed position and act on the rollers 60. By the effect of this double step 61, the carry pawls are released when the car supporting the tip 54 advances. This allows the stringers 55 to open the jaws 63.

The wedges 69', 70 operated by the carry pawls 58 advance, are retained at their initial position by means of spring 74.

The tips 53, 54 support the tube 8. The tip 53 tightens and allows the run of such tube 8 through the jaws 63. The tip 54 acts as an accompanying means and guide of such tube.

Figure 13:
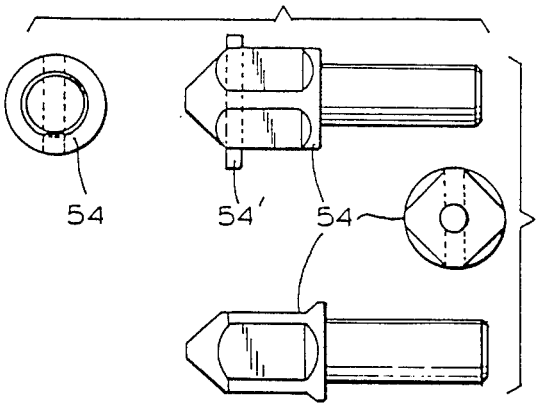
FIGS. 13 through 19 are side views showing various centering and fixing tips for the textile tubes to be cleaned.
Figure 14:
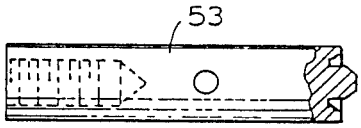
Figure 15:
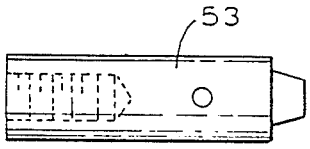
Figure 16:
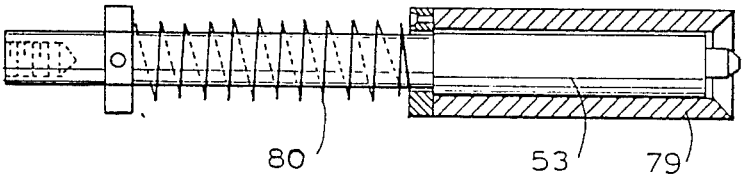
Figure 18:
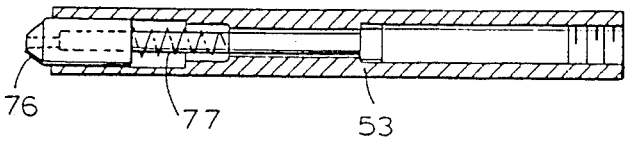
Figure 17:
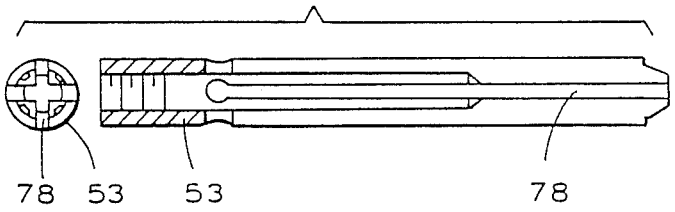
Figure 19:
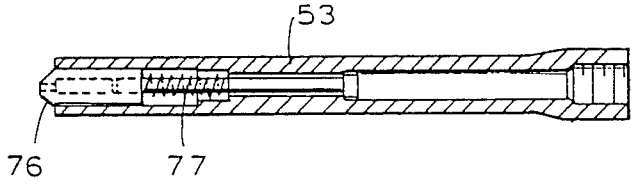

With regard to the centering and retention tip used, the second tip 54 (for the larger base of the tube) has the compact structure represented in FIG. 13 in which is shown a transverse shaft 54' which serves upon its passage to clear the yarn residues which may possibly remain between the jaws 64. Tip 54 of FIG. 13 is a variant of tip 54 of FIG. 9. The other tip 53 may have a variety of shapes. For example, it may be compact (FIGS. 14 and 15), have a telescopic retractable end 76 pressed by springs 77 (FIGS. 18 and 19), have section in the form of a cross 78 so that it may be compressed and expanded radially (FIG. 17), or, it may be provided with a displaceable sleeve 79 compressed by a spring 80 to facilitate expulsion of the leftover yarn deposit about the tip 53, as will be explained below.

Figure 20:
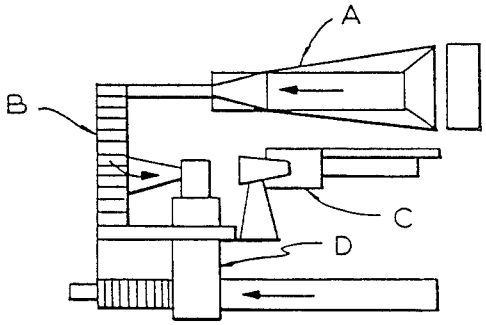
FIGS. 20 and 21 are schematic plan views of two possible embodiments of the tube classifying mechanism of FIGS. 4 through 6*b;*
Figure 21:
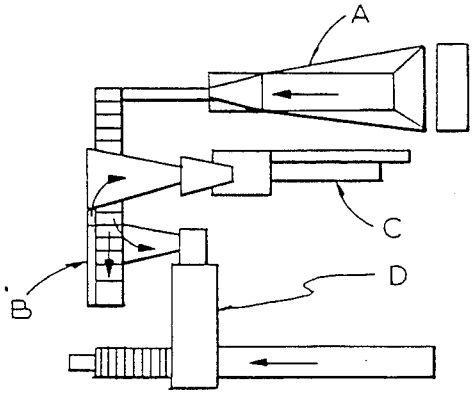

Schematic FIGS. 20 and 21 reproduce the embodiment mentioned above as concerns location and shape of the classifying section. Thus, FIGS. 20 and 21 coincide with FIG. 2 except in the location of the cleaning section C.

Figure 22:
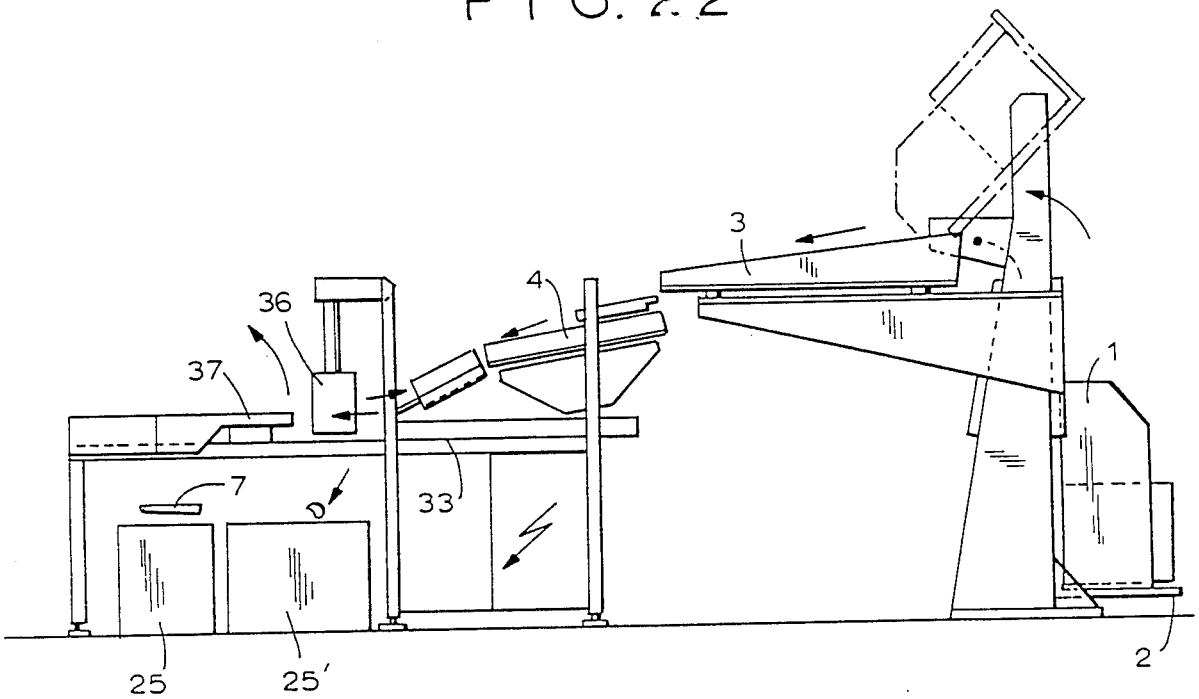
FIGS. 22 and 23 are a front elevation and a plan view, respectively, of a machine pursuant to the present invention designed to function only as a cleaner.
Figure 23:
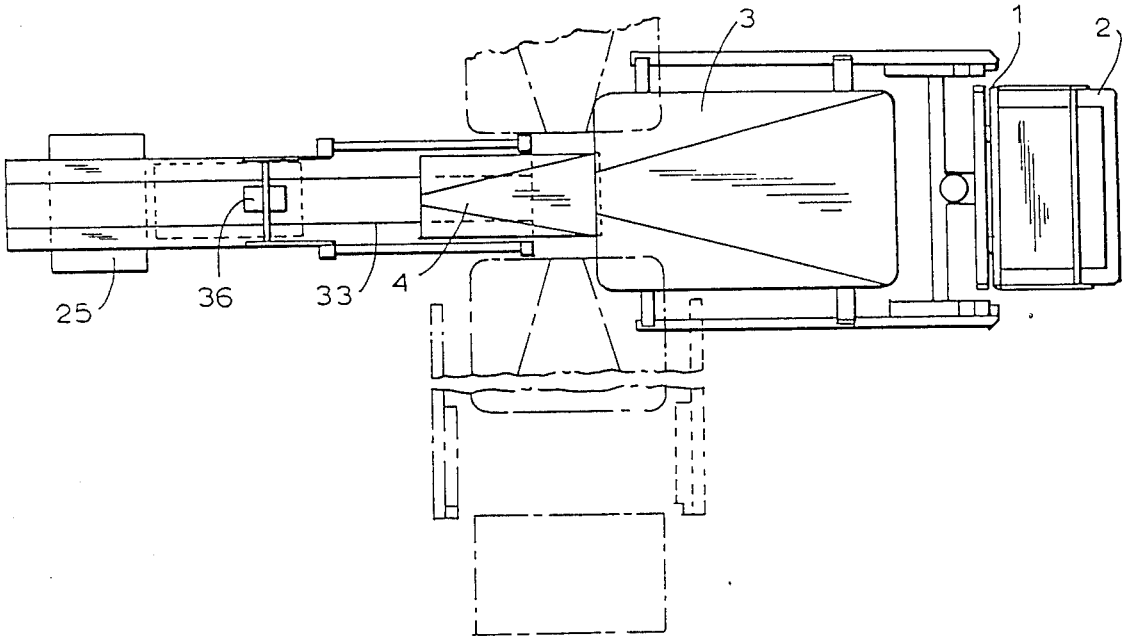

The machine described thus far is designed to perform three fundamental operations, which are the classification, cleaning and arrangement of textile tubes. However, a simplification is shown in FIGS. 22 and 23, wherein only the cleaning of tubes is accomplished. In this simplified machine, the elevator 1, 2, the intake bin 3, the following belt 4, and the bed 33, along with the first mechanism 36 (capture and turning) and the second mechanism 37 (yarn-residue removal) are alternatively used. The clean tube 7 falls directly into the tub 25, while the residues fall onto another similar tub 25'. The dotted lines in FIG. 23 indicate that, instead of a linear assembly of the above-mentioned element, another one at a right angle may be adopted, with the same results and mode of operation as mentioned above.

In addition to the components described, the machine pursuant to this application has other conventionally used elements, such as electric controls for operation of the various mechanical and hydraulic parts mentioned, the elements of which are not explained because their makeup and mode of operation are standard in this technology.

Figure 3A:
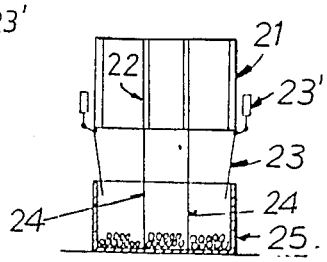
FIG. 3*a* is the same view as FIG. 3 but with the gates open.

The operation of the above-mentioned machine is clearly evident from what is set forth above, it being sufficient merely to summarize with the following points:

The mixed tubes 7, 8 without and with yarn residues, are dumped from the elevator 1 into the bin 3 and passed through the unpiling zone 6 into the classifying mechanism (section B) which separates the clean tubes 7 from the tubes 8 containing yarn. The clean tubes 7 go to the arranging section D, in which the placement of the clean tubes 7 in a single direction within the tubs 25 receiving them takes place. The orientation is insured by the electric channeling device appearing in detail in FIGS. 3 and 3*a*.

The tubes 8 containing yarn are transported (passing through the vibratory bins) to the cleaning section C, where the first mechanism 36 for capture and turning and the second mechanism 37 for extraction or removal of yarn, leave the tubes clean. In this condition they again enter the bin 3, while the yarn residues fall into a suitable tub (such as 25' in FIGS. 22 and 23). The path followed by the tubes, now clean, from the bin 13 until they reach the arranging section, passing through the classifying section B, is the one which has already been described above. Final collection takes place, as always, in the tub 25.

The points of novelty which it is of interest to emphasize in this machine are those relating to the structure and operation of the classifying section, which hitherto was limited to a simple inclined plane, in charge of affecting separating of the tubes. This invention uses a system of an endless chain or belt formed by the plates or pans 12, which are sloped only in a given stretch of their length, which is when the clean tubes (which slip easily because they carry no yarn residues) must be allowed to fall by gravity, while the tubes with yarn do not descend despite their momentary inclination, due to the roughness of the pans themselves, on which the yarn sticks. The embodiments of this mechanism are variable as is shown by the figures, wherein mechanically feasible embodiments are represented in detail. In all cases the motion described, and separation by gravity and adhesion are always fundamental.

The function of the mechanism of capture and turning of the tubes in the cleaning section C (FIGS. 7 and 8) is likewise important. The textile tubes 8 regardless of their orientation, are elastically detained by the spongy member 46 and are then held by the clamps 42, which rotate 180° only if the tubes arrive with their smaller end or base in front, being oriented so that they may immediately be grabbed by the jaws 63 and tips 53 and 54. Displacement of the car 52 is what, by way of its beveled stringers 55, separates the jaws from one another, causing their slide 62, driven by the stringers 55 themselves and over the roller 72, to penetrate into the boxes 49. If backward motion of the rollers 72 coincides exactly with the advance of the wedges 69', 70, which are driven by the pawls 58 and which go on to situate their inclined plane 71 in contact with the rollers 72, then backward movement of the slides 62 is permitted. When the tip 53 advances, the yarn residue contained on the tube 8 (which is likewise displaced with the jaws 63), goes on to be situated on the tip 53 (see FIG. 10). The tube 8 thus being left clean so that when, subsequently, the jaw 63 opens, it falls on the belt 34, to travel into the bin 3. The movement backward of the tip 53 causes the yarn which it has grabbed to be detached upon striking against the elastic strips 75. This residue falls and is collected in a tub (for example, the tub 25').

The jaws 67, contiguous to the jaws 63 previously mentioned, are separated more from one another than are jaws 63, owing to the fact that they go into operation only when there is a large amount of yarn to be removed from the tube 8. If this is the case, these auxiliary jaws 67 remove the first layers of the yarn so that the regular jaws 63 may perform the operation described above.

Tubes having different lengths and diameters can be used without any adjustment. Wedges 69' and 70 adjust themselves to the diameter and conicity of different tubes. This is done simultaneously, that is, one tube of large diameter and small conicity can be cleaned and immediately thereafter so can a tube of lesser diameter and a different conicity.

By tracing the shape of the tube, which can differ every time, no pressure is exerted on the tube. The single most important aspect being to prevent the wedge from moving backward, which would cause the yarn residue to go out of the tubes. Automatic correction of the pins or jaws due to wear is contemplated and accounted for in the invention.

The jaws are self-adjusting, each one by itself and self-centering on the tube, even when the jaws are badly misaligned, either because of defective areas or because of twisting. The jaws follow or retrace any type of conicity, even if concave. Every pin or jaw is autonomous in its action of approaching near to the tube, which is done with a slight pressure. The jaws or pins extend linearly or independent and are perpendicular to the tube axis.

Upon examination of FIG. 10, it is found that a perfect coordination of movements exists for this mechanism to capture the tube 8, to remove the residues of yarn from it and leave it free for its automatic fall. For example, the reason for orientation in one and the same direction in articulation of the jaws 63 and 67, the function of the spring 74 for return of the wedges 69', 70, the task of the pawls 58 tensioned elastically, the adaption of the double step 61, necessary for the pawls 58 to act first on the upper wedge 69' and then on the lower one 70, and other functional details, are clearly understandable per se.

The present invention is automatically fed and requires no personnel to intervene. Yarn extraction is progressively effected (when there is a residue excess) by means of fixed and stepped jaws 67 (FIG. 10). The extraction jaws and nails 63 (FIG. 10) are made of medium-hard material, allowing for a soft contact with tube for perfect tracing or follow-up and for cleaning. The jaws cannot be moved backward because of the wedges 69' and 70 (FIGS. 9 and 10). The thrust is adjustable hydraulically, which is very important for fragile tubes (e.g. those that are carboard, etc.). No pre-adjustment is needed for different type tubes (e.g. those with differing diameters, conicity, and length). It can be fed from tubs or from the classifier. No rotary part can catch the yarn. The jaws extend linear and independent and are always perpendicular to the tube axis.

Figure 33:
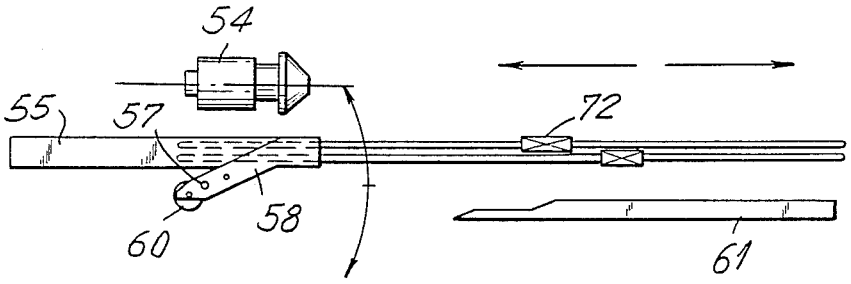
FIG. 33 is a schematic representation of the wedges system depicted in FIG. 9.

FIG. 33 shows the wedges system schematically in which the wedges 69', 70 are formed to adapt the jaws 63 to clean the textile tube in an individual manner. FIGS. 34–39 are explanatory views depicting the wedges system in progressive working positions.

Figure 34:
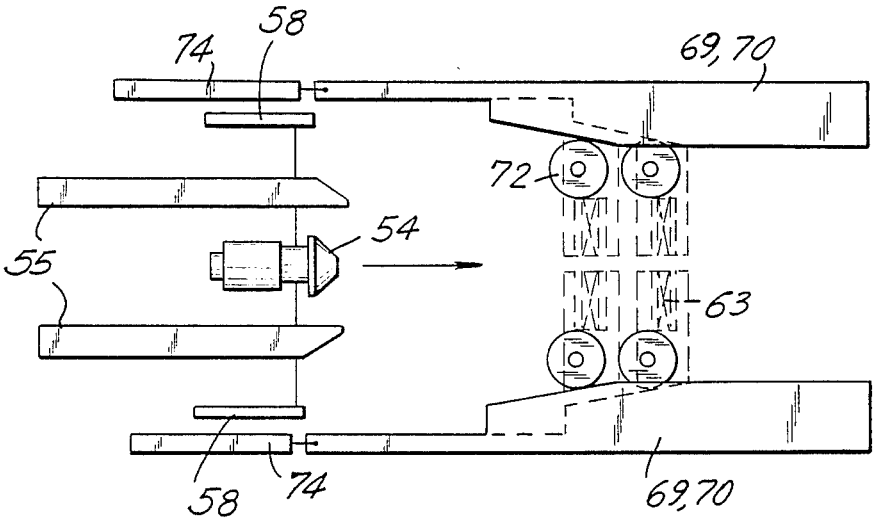
FIGS. 34–39 are top plan views for explanatory purposes similar to FIG. 10 and which depict the wedges system of FIG. 3 in progressing working positions.
Figure 35:
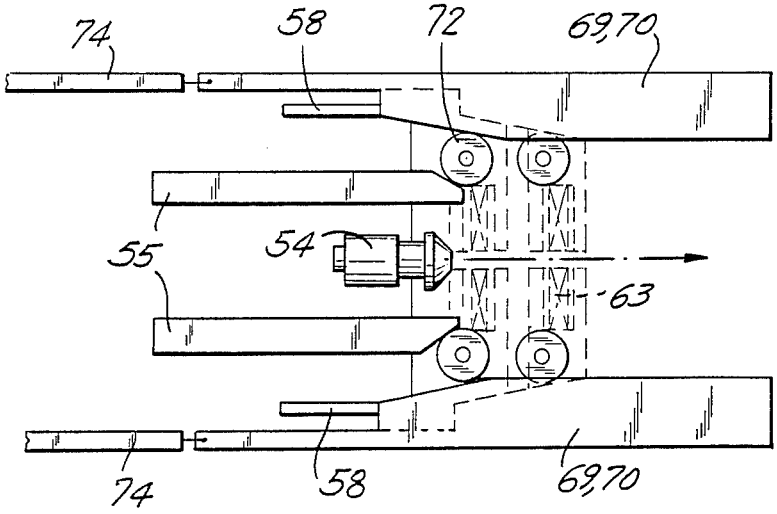
Figure 36:
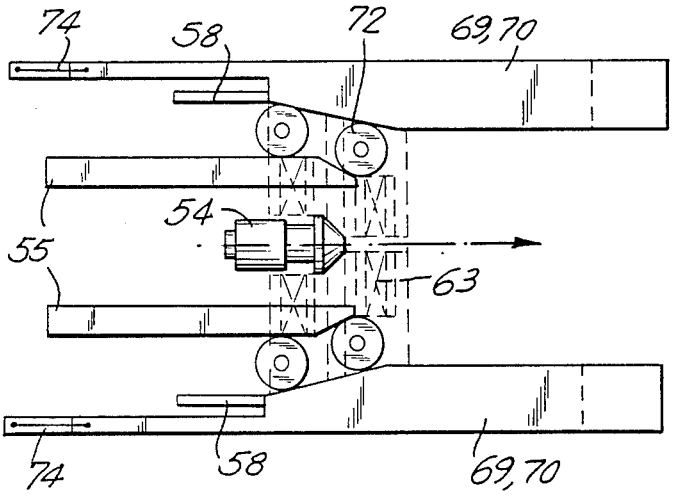
Figure 37:
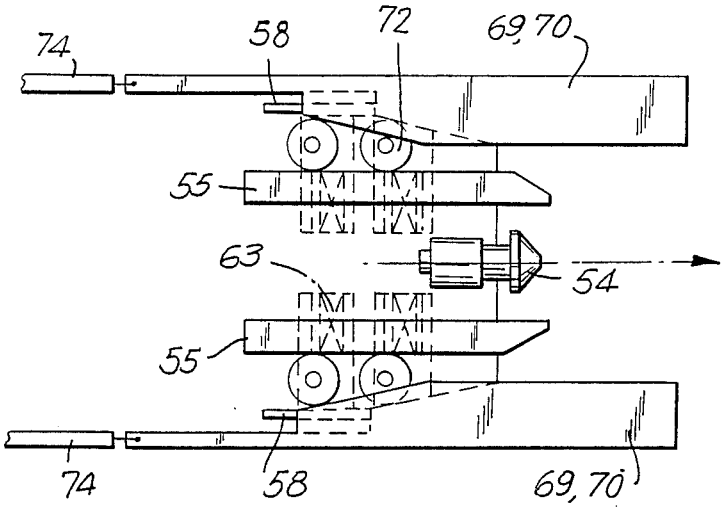

FIG. 34 shows the jaws 63 in a closed position and a tip 54 at an end of the course. FIG. 35 shows the stringers 55 in position to open the first set of jaws 63 and the carry pawl 58 in contact with the upper wedge. FIG. 36 shows the first set of jaws in an open position and the stringers 55 in position to commence opening the second set of jaws. FIG. 37 shows both sets of jaws in an open position and the tip 54 in a more advanced position.

The second set of jaws were opened after the carry pawl 58 was positioned to lose contact with the upper wedge and make contact with the lower wedge via double step 61. Tracing by the wedges system is moved back to a maximum point and carried out by means of the pawl.

Figure 38:
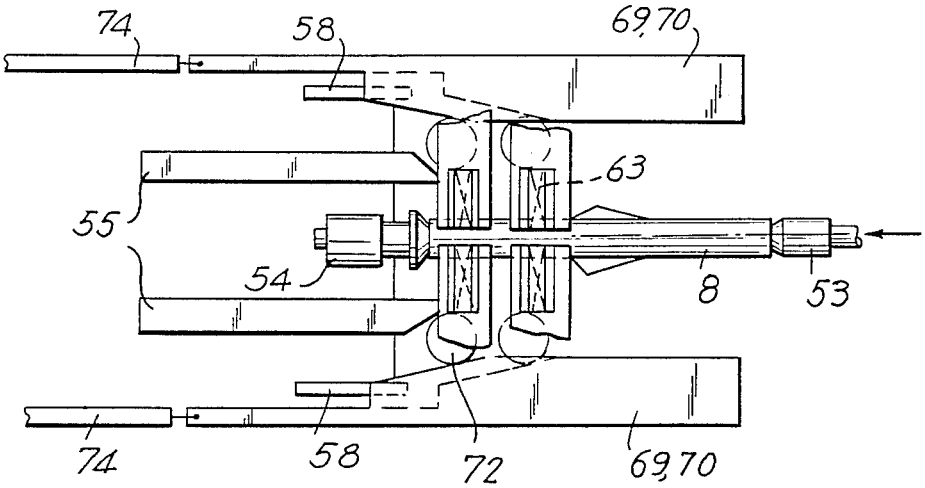
Figure 39:
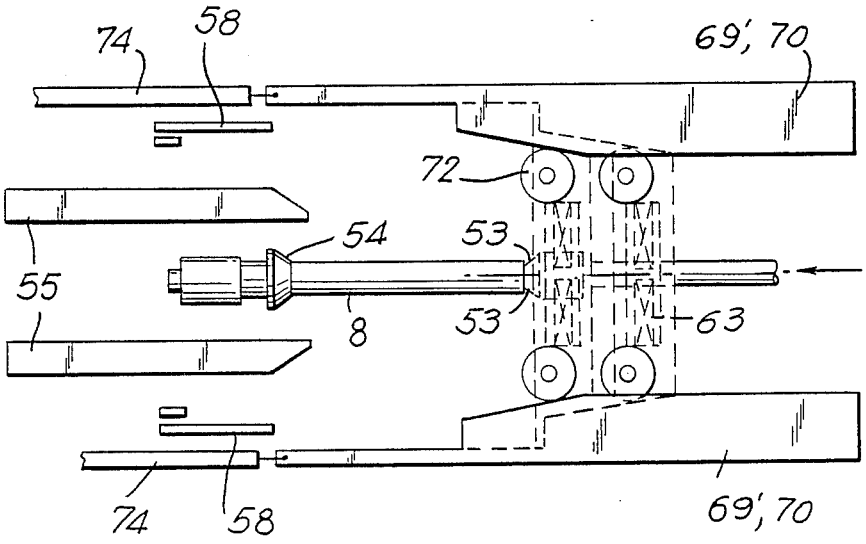

FIG. 38 shows the run back phase in which the tip 54 is moved backward with the tube 8 passing between the jaws 63. FIG. 39 shows the final phase of the backward motion in which the tube 8 has been cleaned.

The materials, shape and dimensions of the elements comprising the clasp 9, cleaning and arranging machine having the features described will be independent of the subject matter of the invention, provided that the variations introduced do not affect its essential nature.

by "guide member" in the following claims we mean one of the cars 50, 51 on which one of the tips 53, 54 is formed and associated parts. When the tips are moved toward each other or one tip is moved toward the other, the tips engage on the ends of one of the textile tubes to be cleaned.

While the invention has been illustrated and described as embodied in a machine for classifying, cleaning and arranging textile tubes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for removing yarn residue from textile tubes, each of said textile tubes having a wider end and a narrower end comprising:

a plurality of jaws between which each of said textile tubes is positionable so said jaws close on said yarn residue;

means for opening said jaws including a plurality of rollers and biased wedges, said wedges abutting on said rollers and said jaws, a plurality of stringers arranged to engage and push apart said rollers and thereby push apart said wedges and said jaws, and pawl means for guiding said stringers into engagement with said rollers for moving apart said jaws;

means for closing said jaws into the yarn residue so as to minimize a pressure exerted by said jaws on the textile tubes, said closing means including biasing means which bias said jaws to close towards each other; and guide means for guiding said textile tubes including tips between which the textile tube is holdable longitudinally and a guide member formed so as to center the textile tubes relative to said jaws, one of said tips being arranged to receive the yarn residue retained by said jaws and the other of said tips being formed on said guide member, said one tip having a displaceable spring-loaded sleeve so that the yarn residue is collected with the help of said sleeve and means for displacing said sleeve so as to expel the yarn residue collected thereby, each of said tips having a tapered end suitable for engaging different diameters of said textile tubes, said guide member being moveable in opposite directions between said jaws so that said opening means opens said jaws in response to said guide member being moved in one of said opposite directions and said closing means closes said jaws in response to said guide member being moved in the other of said opposite directions so that said jaws close into and retain the yarn residue as said guide member moves.

2. A device for removing yarn residue from textile tubes according to claim 1, wherein said jaws are made of a semihard material so as not to cause damage to the textile tubes when closed thereon.

3. A device for removing yarn residue from textile tubes according to claim 1, in which said other tip has a retractable elastically tensioned telescopic end.

4. A device for removing yarn residue from textile tubes according to claim 1, further comprising a means for turning and aligning the textile tubes one by one so as to consistently feed the wider end of the tubes first toward said jaws so that the textile tubes are guided between said jaws by said guide means.

5. A device for removing yarn residue from textile tubes according to claim 1, wherein said biasing means comprises compression springs each of which is connected to one of said jaws.

6. A device for removing yarn residue from textile tubes according to claim 1, wherein said guide member includes said tips and two cars moveably mounted on two parallel rails, said tips being mounted on said cars so that when said tips move toward each other said tips are engagable with both ends of one of said textile tubes.

* * * * *